US005718507A

United States Patent [19]

Gian

[11] Patent Number: 5,718,507

[45] Date of Patent: Feb. 17, 1998

[54] DOSIFYING APPARATUS FOR MIXING A BATCH OF MIXED LIQUID PRODUCT FROM SEPARATE BULK SOURCES OF SUPPLY OF A LIQUID CARRIER AND AN ADDITIVE

[76] Inventor: Michael Gian, 1502 Kingsbury Rd., Garden City, Kans. 67846

[21] Appl. No.: 507,643

[22] Filed: Jul. 25, 1995

[51] Int. Cl.[6] ..... B01F 15/02

[52] U.S. Cl. ..... 366/131; 366/150.1

[58] Field of Search ..... 366/177.1, 179.1, 366/181.1, 181.2, 181.3, 181.8, 182.1, 182.3, 189, 190, 167.1, 114, 158.4, 191, 132, 150.1, 131

[56] References Cited

U.S. PATENT DOCUMENTS

| | | | |
|---|---|---|---|
| 2,737,129 | 3/1956 | Johnson et al. | 366/181.1 |
| 2,746,728 | 5/1956 | Pomerleau . | |
| 3,560,430 | 2/1971 | Meyer et al. | 366/177.1 |
| 3,782,695 | 1/1974 | Sandiford | 366/181.8 |
| 3,870,283 | 3/1975 | Hurst | 366/191 |
| 3,920,223 | 11/1975 | Krueger | 366/177.1 |
| 3,995,838 | 12/1976 | Zucker | 366/165.1 |
| 4,125,331 | 11/1978 | Chisholm . | |
| 4,185,927 | 1/1980 | Uttech | 366/131 |
| 4,367,953 | 1/1983 | Hinz et al. | 366/132 |
| 4,430,001 | 2/1984 | Schurr . | |
| 4,439,042 | 3/1984 | Bertoglio . | |
| 4,499,561 | 2/1985 | Mason et al. | 366/158.4 |
| 4,640,622 | 2/1987 | Sortwell . | |
| 4,668,945 | 5/1987 | Aldrovandi et al. . | |
| 4,712,921 | 12/1987 | Sugiura | 366/336 |
| 4,778,280 | 10/1988 | Brazelton | 366/181.8 |
| 4,801,210 | 1/1989 | Gian . | |
| 4,859,072 | 8/1989 | Fey et al. . | |
| 5,190,374 | 3/1993 | Harms et al. . | |
| 5,344,619 | 9/1994 | Larwick et al. | 366/167.1 |
| 5,368,385 | 11/1994 | Adamo et al. | 366/181.1 |

*Primary Examiner*—Tony G. Soohoo

*Attorney, Agent, or Firm*—Hovey, Williams, Timmons & Collins

[57] ABSTRACT

A system for applying accurately metered, minute quantities of concentrated additives from bulk sources of supply to successive masses of material presented for treatment includes a pass-through chamber within which separate streams of a liquid carrier and the additive substance are merged together. As the liquid carrier passes through the chamber, the additive, in either dry or liquid form, is likewise directed into the chamber in a metered flow to incrementally combine with the liquid stream and form the combined product. A suction pump at the downstream end of the chamber draws the prepared product out of the chamber and advances it toward an ultimate delivery site. The carrier liquid is prevented from accumulating into a pool within the chamber by the suction pump that cooperates with the upright orientation of the chamber to cause the carrier liquid to swirl smoothly through the chamber. A suction vortex may be created as the product exits the chamber, within which vortex the additive may be directed so as to complete its entrainment with the carrier without causing turbulence. The system can be easily flushed with the liquid carrier after each batch and then dried with an optional air blower.

25 Claims, 1 Drawing Sheet

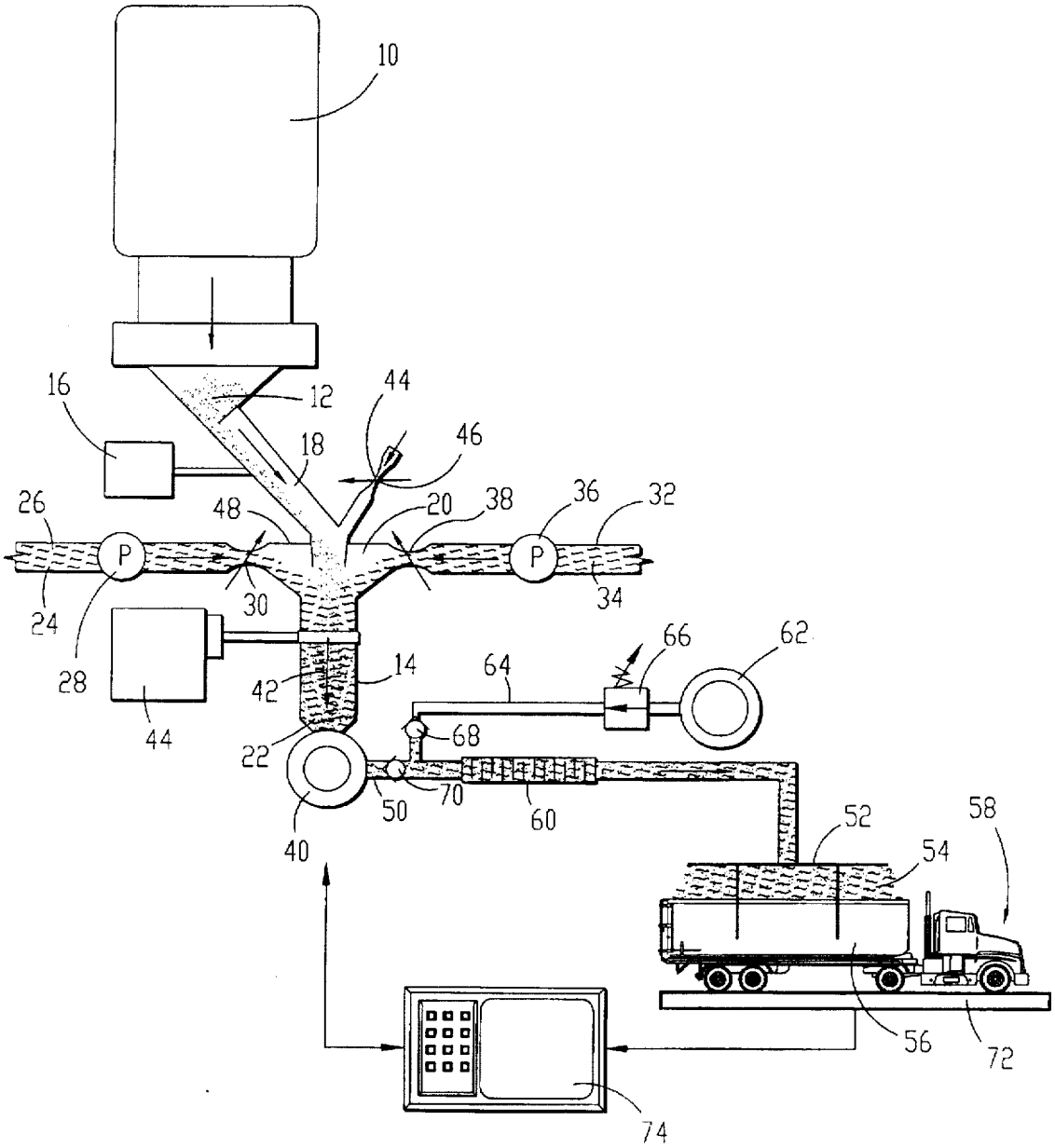
10
16
12
44
46
18
26
48
20
38
36
32
P
P
24
30
34
28
44
42
14
64
66
62
68
22
50
70
60
40
52
58
54
56
72
74

DOSIFYING APPARATUS FOR MIXING A BATCH OF MIXED LIQUID PRODUCT FROM SEPARATE BULK SOURCES OF SUPPLY OF A LIQUID CARRIER AND AN ADDITIVE

TECHNICAL FIELD

The present invention relates generally to the field of dosifying systems and, more particularly, is directed toward a system for applying very small amounts of additive substances from a bulk supply source to a much larger mass of materials at a treating station.

BACKGROUND OF THE INVENTION

My prior U.S. Pat. No. 4,801,210 titled Method and Apparatus for Continuous Mixing of Small, Precise Quantities of Bulk Materials with a Liquid Stream discloses and claims a method and apparatus for mixing relatively small, metered amounts of innoculant powder or the like with a moving carrier stream of oil or the like. While this system eliminates the need for vats and mixing bowls, and all of their attendant disadvantages, my earlier system is designed to be pressurized throughout all regions of the system, which has the disadvantage of adding undue expense and complexity to the system.

SUMMARY OF THE PRESENT INVENTION

Accordingly, one important object of the present invention is to improve upon the concepts of my prior patent by eliminating the need for pressurization while retaining the advantages of the earlier system with respect to mixing of the ingredients "on the go", thus avoiding vats, bowls and other undesirable apparatus that are difficult to clean and present other problems.

Another important object of the present invention is to provide a system which can be quickly and easily cleaned following each use to avoid the risk of cross-contamination and the possibility that residue from a prior batch will accidentally be introduced into a current batch, which would impair the accuracy of the results.

An additional important object of the present invention is to provide a system which permits easy and precise adjustments to the amounts of various ingredients added to the batch while the system is ongoing.

Yet another important object of the present invention is to provide a system which is particularly suited for, but not limited to, the addition of very small quantities of concentrated micro-ingredients, such as microbial drugs, from bulk containers to large quantities of other materials such as animal feed.

A further important object of the present invention is to provide a system which is conducive to computer controls so that the system can be made highly automated yet capable of accurately adjusting the amount of additive dispensed so as to maintain a predetermined concentration of the additive despite variations in the sizes of successive masses of material presented for treatment.

Additionally, an important object of the present invention is to provide a system that, in one form, utilizes an airstream under pressure to not only assist in propelling the mixed batch of additive to the ultimate delivery location, but also to dry the various passages of the system following each use.

These and other important objects of the present invention are obtained through the provision of a system and method wherein additive materials, either in dry or liquid form, are carefully dispensed in a metered flow into an ongoing stream of carrier liquid in a pass-through, tubular mixing chamber. Preferably, the additive is dispensed by gravity into the stream of carrier liquid as it passes through the chamber such that each increment of the moving liquid is matched up with a corresponding increment of the additive material; the resulting product can then be sprayed or otherwise applied to the mass of waiting materials. A suction at the outlet of the chamber draws the liquid away from the chamber in a smooth laminar flow. In its preferred form, the chamber is arranged in an upright condition with its outlet disposed at the bottom of the chamber and the additive inlet located in a position to drop the additive directly into the outflowing stream of liquid. The smooth flowing liquid washes away any additive that tends to stick to the inside walls of the chamber. In the event liquid starts to accumulate in the chamber, it forms a laminar swirling discharge vortex that keeps the liquid flowing smoothly and prevents additive from sticking to the walls. Ideally, the additive is dispensed directly into the vortex.

If necessary or desirable, the liquid carrier and additive stream may be passed through a region downstream from the mixing chamber wherein the ingredients are agitated to achieve a thorough mixing action. Furthermore, air may be injected into the system at that location to both assist in propelling the product along the line downstream from the mixing chamber, and to help dry out the line at the completion of the dispensing procedure after the system has been thoroughly flushed out.

BRIEF DESCRIPTION OF THE DRAWING

The single FIGURE of the drawing schematically illustrates a dosifying or materials application system and method in accordance with the principles of the present invention.

DETAILED DESCRIPTION

The present invention has been illustrated and will hereinafter be described in connection with a system for adding micro ingredients to large quantities of other materials such as, for example, adding small quantities of concentrated drug products to truck loads of cattle feed. It will be appreciated, however, that the principles of the present invention are not limited to that particular use and may be applied to a wide variety of material handling situations where relatively small accurately measured amounts of additive material, particularly but not exclusively in dry form, need to be added to larger quantities of another substance. Thus, the references herein to animal feed, truck systems, drug additives and other such expressions are understood to be made by way of example only and not for purposes of limitation.

The system of the present invention includes a hopper or other container 10 serving as a source of supply for concentrated additive. In the illustrated embodiment, the hopper 10 is designed to store a supply of dry additive, but the hopper could be designed for holding liquid additive as well. Suitable metering mechanism in the nature of an auger or other means feeds the dry additive 12 from the hopper 10 toward a tubular, pass-through mixing or combining chamber 14 where the additive 12 is combined with a suitable liquid carrier, such as oil or water. In the illustrated embodiment, a vibrator 16 coupled with a downwardly sloping delivery conduit 18 serves to accurately meter the dry additive 12 into the chamber 14.

The chamber 14 is preferably arranged in an upright disposition so that an inlet 20 is presented at its upper end and an outlet 22 is presented at its lower end. The delivery conduit 18 from the additive supply hopper 10 projects down into the outwardly flaring inlet 20 so that the additive 12 is dropped in a metered flow directly into the inlet 20, preferably in the center thereof.

At least one type of liquid carrier is supplied to the mixing chamber 14 for combining with the additive 12. In the illustrated embodiment, one delivery conduit 24 leads from a source of bulk supply of liquid carrier 26, such as water, and empties directly into the inlet 20. A pump 28 moves the carrier through the conduit 24, and a variable outlet orifice 30 in conduit 24 permits the rate and volume of flow to be controlled. If desired, a second delivery conduit 32 for liquid carrier may be provided, depending upon the ultimate mixture to be obtained, such conduit 32 containing a second liquid carrier 34, having a second pump 36, and being provided with a second variable outlet orifice 38.

A discharge pump 40 is coupled with the chamber outlet 22 so as to draw a suction on the chamber 14. Thus, additive and liquid carrier introduced into the inlet 20 by their respective sources of supply are combined within the chamber 14 into what may be described as a mixed liquid product, which product is then pumped to downstream portions of the system by the discharge pump 40. The capacities and flow volume rates of the pumps 26, 28 and 40, as well as the relative cross-sectional sizes 20 of the outlets 22, 30 and 38 should be so regulated that the product formed within the chamber 14 does not collect in a pool within the chamber but instead is constantly flowing through the chamber at a steady rate. The liquid carrier is presented to the inlet 20 in the form of a steady stream for mixing with the metered flow of the additive. In this way, the additive combines with the liquid carrier increment by increment, instead of all at one time as in a vat type mixing system. Furthermore, the incoming liquid continuously washes the walls of the chamber to keep additive from sticking to those surfaces.

It is highly desirable to obtain laminar flow through the chamber 14. Therefore, it may be desirable in some instances to not only draw a suction on the outlet 22 of the chamber 14 with the pump 40, but also to form a suction vortex illustrated by the numeral 42 within the mixed product above the outlet 22. When the vortex 42 is present, the product swirls around the interior of the chamber 14 in a laminar flow manner and thus moves quickly through the system without causing dead spots in the flow where the additive can settle out. The swirling vortex also keeps the additive from sticking to the walls of the chamber. The vertical orientation of the chamber 14 is beneficial in creating the suction vortex inasmuch as the force of gravity helps draw the liquid out of the chamber 14 through the outlet 22. Preferably, the cross-sectional area of the outlet 22 exceeds the effective combined cross-sectional areas of the outlet orifices 30 and 38 at all times so that the product within chamber 14 cannot collect to such a level that it will engage the bottom end of the additive delivery conduit 18. Additionally, it is preferred that the upper end of the chamber 14 at the inlet 20 be generally funnel shaped with sloping interior surfaces. The liquid streams thus entering the chamber 14 engage and flow along the sloping surfaces of the inlet 20 toward the outlet 22 with a tendency to swirl as they flow. A vibrator 44 below the inlet 20 is mechanically coupled with the chamber 14 and may be utilized to oscillate the chamber 14 in a circular motion so as to augment the swirling action obtained within the chamber 14 and the conical inlet 20.

Intersecting the additive supply conduit 18 at a point above the chamber 14 is a gas delivery passage 44 having a variable outlet orifice 46. The passage 44 may be used to supply the chamber 14 and downstream portions of the system with an additive gas under pressure. On the other hand, the passage 44 could also be used to simply draw in ambient air in regulated amounts so as to adjust the suction available from the pump 40. In either case, the upper end of the chamber 14 is preferably provided with a closure 48 that seals the chamber 14 from the atmosphere, except that air which may be supplied via the passage 44 when the same is used to admit ambient air. In some situations, such as when no gas is desired to be introduced to the chamber 14, the closure 48 may be eliminated such that the funnel area is completely open to the atmosphere.

The pump 40 discharges the product with positive pressure into a discharge conduit 50 leading to a dispensing head 52. In one use of the invention, the dispensing head 52 may be positioned in such a manner as to release the product in the form of a spray 54 that is directed onto the contents of an open top container 56 forming part of a truck 58. The container 56 with its mass of animal feed and dose of micro ingredients from the additive supply hopper 10 can be thereafter delivered to the feeding site or other location for ultimate distribution.

In some situations it may be desirable to provide an augmentation chamber 60 within the discharge conduit 50 which subjects the product to agitation and additional mixing after the ingredients have been combined within the chamber 14 and moved through the discharge pump 40. The augmentation chamber 60 may take a variety of different forms including, for example, a set of staggered deflecting baffles or the like within the path of flow of the product to force the product to move in a serpentine path and create turbulence.

It may also be necessary to add positive pressure air to the discharge conduit 50 downstream from the pump 40 to assist in transferring the product through the augmentation chamber 60 and the rest of the downstream portions of the discharge conduit 50. Such positive pressure air may be supplied by an air pump 62 connected to the discharge line 50 via a supply line 64. A control valve 66 in the line 64 regulates the volume of air added to the discharge conduit 50, and a check valve 68 downstream from the control valve 66 but upstream from the discharge conduit 50 prevents product from entering the air supply line 64 to any significant extent. Another check valve 70 in the discharge line 50 downstream from the pump 40 prevents air from the supply pump 62 from entering the discharge pump 40. The air from blower 62 can also be utilized to dry out the discharge line 50 and the augmentation chamber 60 after each batch of product has been prepared and distributed. Preferably, the entire system is flushed prior to such drying action by simply allowing the appropriate liquid carrier 26 or 34 to pass through the chamber 14, pump 40 and discharge conduit 50 without the introduction of any additive from the supply hopper 10.

It is contemplated that when the truck 58 arrives at the dispensing station as illustrated in the drawing, the contents of the container 56 may be weighed using a scale 72 that inputs the resulting information to a computer 74. Information concerning the amount of additive to be dispensed for a certain weight of the mass within the truck container 56 has previously been stored within the computer 74 such that, when the weight of the contents is known, the computer 74 can then appropriately signal the rest of the system to release only the appropriate amount of additive from the hopper 10 for that particular job. Thus, for each truck that arrives, the system has the ability to adjust itself to supply a batch of additive in accordance with a pre-established concentration schedule. In other words, if a certain amount of additive is desired per each unit of mass to be treated, that concentration can be maintained despite significant variations in the weights of succession masses of materials delivered to the dispensing station. It is only necessary to so program the computer 74 that it will allow only the proper amount of additive to be released from hopper 10 that is appropriate for the particular mass of material at the dispensing station.

It is also to be understood that the present invention contemplates the use of several different additive hoppers 10, each containing their own particular additive. Thus, the weight of the mass of material within the truck container 56 can be utilized to determine how much additive from several different hoppers is to be dispensed to the material within the truck container. Each hopper would be associated with its own mixing chamber and liquid carrier supply stream, as well as its own discharge line to the point of dispensing the product onto the material within the truck container. At that location, the various lines could be merged together into a common dispensing head, or the truck could be advanced seriatim along a line of several different dispensing heads according to the number of hoppers utilized.

It is also important to appreciate that the present invention has particular utility in connection with the preparation and dispensing of relatively small amounts of additive and liquid carrier, compared to the relatively large masses of materials contained within the successive truck containers 56. For example, in one use of the system, with water as the liquid carrier, water usage totaled six quarts, while only 0.30 lbs. of additive were supplied. The truck container, on the other hand, may contain 7 tons of feed. The supply hopper for the additive may contain on the order of 50–60 lbs. of the additive.

Typical additives dispensed by the system have included drugs such as BIOTAL, CATALYST, DECCOX, BOVATEC, RUMENSIN 80, ZINPRO 100, TYLAN 40, and TM 100. Wheat flour has also been successfully dispensed.

In one embodiment of the invention, liquid carrier in the form of water was supplied to the liquid metering system with a 5 gallon tank and platform scale available from the Peabody Corporation of Parsons, Kans. Each additive hopper was a 2"×6" offset feeder with 0.5 C.F. hopper and electromagnetic drive also available from the Peabody Corporation Company of Parsons, Kans. The additive hopper included means for agitating the delivery conduit 18 in a maximum amplitude of 0.06", and the total weight of the hopper, feeder and drive was approximately 60 pounds empty. The mixing chamber 14 comprised a section of 2" diameter PVC pipe and the outlet from the water supply line was on the order of ¼" in diameter. The discharge conduit 50 was 1" diameter PVC pipe, and the air line 64 connected to the discharge conduit 50 was a ½" diameter hose. Included as part of the system was a controller available from the Peabody Corporation of Parsons, Kans. identified as a series 1100 Batch Controller.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his/their invention as pertains to any apparatus not materially departing from but outside the literal scope of the invention as set out in the following claims.

What is claimed is:

1. In a dosifying system for making a batch of mixed liquid product from separate bulk sources of supply of a liquid carrier and an additive, the improvement comprising:

a tubular chamber having an inlet and an outlet;

means for delivering the liquid carrier to the inlet of the chamber in a stream;

mechanism for incrementally delivering a measured quantity of the additive to the inlet in a metered flow for combining an additive flow and the carrier stream in the chamber to produce the product;

a discharge pump coupled with the outlet of the chamber for drawing product out of the chamber as the liquid stream and additive flow are combined within the chamber:

a delivery conduit coupled with the pump in downstream relation to the chamber for receiving product from the pump and directing the product to a point of delivery; and means for agitating said chamber as the stream of liquid carrier and additive flow are combined in the chamber.

2. In a dosifying system as claimed in claim 1, said chamber being disposed with said outlet below said inlet.

3. In a dosifying system as claimed in claim 2, said chamber having a conical portion, with sides that converge as said outlet is approached.

4. In a dosifying system as claimed in claim 2, said delivery means for the liquid carrier having an outlet, said chamber outlet having a larger cross-sectional area than said outlet of the liquid carrier delivery means.

5. In a dosifying system as claimed in claim 1 said mechanism including structure to deliver dry additive material to the chamber.

6. In a dosifying system as claimed in claim 5, said chamber having a bottom end, said outlet being centrally located within said bottom end of the chamber and said inlet being located above said outlet, said delivery mechanism being disposed to release the dry additive material into the chamber in generally vertical alignment with the outlet at a point spaced above the outlet.

7. In a dosifying system as claimed in claim 1, said chamber communicating with means for admitting gas to the chamber, and preventing its escape.

8. In a dosifying system as claimed in claim 7, said gas admitting means including a valve for adjusting the amount of gas admitted to the chamber.

9. In a dosifying system as claimed in claim 1, said additive metering mechanism including means for delivering additive in liquid form to the chamber.

10. In a dosifying system as claimed in claim 1, said delivery conduit containing a plurality of baffles disposed to cause the product to experience turbulence as it encounters the baffles.

11. In a dosifying system as claimed in claim 1, said pump being operable to create a suction vortex at the outlet as the product is discharged from the chamber.

12. In a dosifying system for making a batch of mixed liquid product from separate bulk sources of supply of a liquid carrier and an additive, the improvement comprising:

a tubular chamber having an inlet and an outlet;

means for delivering the liquid carrier to the inlet of the chamber in a stream;

mechanism for incrementally delivering a measured quantity of the additive to the inlet in a metered flow for combining an additive flow and the carrier stream in the chamber to produce the product;

a discharge pump coupled with the outlet of the chamber for drawing product out of the chamber as the liquid stream and additive flow are combined within the chamber;

a delivery conduit coupled with the pump in downstream relation to the chamber for receiving product from the pump and directing the product to a point of delivery; and a blower coupled with said delivery conduit for introducing air under positive pressure to said conduit.

13. In a system for supplying successive batches of product containing a liquid carrier and predetermined amounts of additive material to a point of delivery, the improvement comprising:

a tubular chamber having an inlet and an outlet;

a bulk source of supply of the liquid carrier:

means for delivering a volume of the liquid carrier from the source of supply to the inlet of the chamber for each batch of product, said delivery means being operable to deliver each volume of the liquid carrier to the chamber in a liquid stream;

a bulk source of supply of the additive;

mechanism for delivering a measured quantity of the additive from the bulk source of supply of the additive to the inlet of the chamber for each batch of product, said mechanism being operable to deliver each quantity of the additive to the chamber in a metered flow for combining an additive flow and the carrier stream in the chamber to produce the batch of product:

a discharge pump coupled with the outlet of the chamber for drawing product out of the chamber as the liquid stream and additive flow are combined within the chamber:

a delivery conduit coupled with the pump in downstream relation to the chamber for receiving product from the pump and directing the product to said point of delivery until the entire batch has been delivered;

control apparatus operably connected with said additive delivery mechanism for controlling the size of said quantity of additive material in each successive batch of product; and means for agitating said chamber as the stream of liquid carrier and additive flow are combined in the chamber.

14. In a system for supplying successive batches of product as claimed in claim 13, said chamber being disposed with said outlet below said inlet.

15. In a system for supplying successive batches of product as claimed in claim 14, said chamber having a conical portion, with sides that converge as said outlet is approached.

16. In a system for supplying successive batches of product as claimed in claim 14, said delivery means for the liquid carrier having an outlet, said chamber outlet having a larger cross-sectional area than said outlet of the liquid carrier delivery means.

17. In a system for supplying successive batches of product as claimed in claim 13, said mechanism including structure to deliver dry additive material to the chamber.

18. In a system for supplying successive batches of product as claimed in claim 17, said chamber having a bottom end, said outlet being centrally located within said bottom end of the chamber and said inlet being located above said outlet, said delivery mechanism being disposed to release the dry additive material into the chamber in generally vertical alignment with the outlet at a point spaced above the outlet.

19. In a system for supplying successive batches of product as claimed in claim 13, said chamber communicating with means for admitting gas to the chamber, and preventing its escape.

20. In a system for supplying successive batches of product as claimed in claim 19, said gas admitting means including a valve for adjusting the amount of gas admitted to the chamber.

21. In a system for supplying successive batches of product as claimed in claim 13, said additive metering mechanism including means for delivering additive in liquid form to the chamber.

22. In a system for supplying successive batches of product as claimed in claim 13, said delivery conduit containing a plurality of baffles disposed to cause the product to experience turbulence as it encounters the baffles.

23. In a system for supplying successive batches of product as claimed in claim 13, said pump being operable to create a suction vortex at the outlet as the product is discharged from the chamber.

24. In a system for supplying successive batches of product containing a liquid carrier and predetermined amounts of additive material to a point of delivery, the improvement comprising:

a tubular chamber having an inlet and an outlet;

a bulk source of supply of the liquid carrier;

means for delivering a volume of the liquid carrier from the source of supply to the inlet of the chamber for each batch of product, said delivery means being operable to deliver each volume of the liquid carrier to the chamber in a liquid stream;

a bulk source of supply of the additive;

mechanism for delivering a measured quantity of the additive from the bulk source of supply of the additive to the inlet of the chamber for each batch of product, said mechanism being operable to deliver each quantity of the additive to the chamber in a metered flow for combining an additive flow and the carrier stream in the chamber to produce the batch of product;

a discharge pump coupled with the outlet of the chamber for drawing product out of the chamber as the liquid stream and additive flow are combined within the chamber;

a delivery conduit coupled with the pump in downstream relation to the chamber for receiving product from the pump and directing the product to said point of delivery until the entire batch has been delivered;

control apparatus operably connected with said additive delivery mechanism for controlling the size of said quantity of additive material in each successive batch of product; and a blower coupled with said delivery conduit for introducing air under positive pressure to said conduit.

25. In a system for supplying successive batches of product containing a liquid carrier and predetermined amounts of additive material to a point of delivery, the improvement comprising:

a tubular chamber having an inlet and an outlet;

a bulk source of supply of the liquid carrier;

means for delivering a volume of the liquid carrier from the source of supply to the inlet of the chamber for each batch of product, said delivery means being operable to deliver each volume of the liquid carrier to the chamber in a liquid stream;

a bulk source of supply of the additive;

mechanism for delivering a measured quantity of the additive from the bulk source of supply of the additive to the inlet of the chamber for each batch of product, said mechanism being operable to deliver each quantity of the additive to the chamber in a metered flow for combining an additive flow and the carrier stream in the chamber to produce the batch of product;

a discharge pump coupled with the outlet of the chamber for drawing product out of the chamber as the liquid stream and additive flow are combined within the chamber;

a delivery conduit coupled with the pump in downstream relation to the chamber for receiving product from the pump and directing the product to said point of delivery until the entire batch has been delivered;

control apparatus operably connected with said additive delivery mechanism for controlling the size of said quantity of additive material in each successive batch of product, said delivery conduit having a distributor at said point of delivery for applying the product to successive masses of material placed at said point of delivery; and means for determining the weight of each mass of material prior to applying the product thereto, said control apparatus being operably connected to said weighing means for determining the size of each of said quantities of additive material as a function of the weight of the corresponding mass at said point of delivery.

* * * * *